United States Patent [19]

Moorehead

[11] 4,400,948

[45] Aug. 30, 1983

[54] AIR DRYER

[76] Inventor: Jack F. Moorehead, 6432 Birchwood St., San Diego, Calif. 92120

[21] Appl. No.: 334,732

[22] Filed: Dec. 28, 1981

[51] Int. Cl.³ ..... F25B 21/02

[52] U.S. Cl. ..... 62/3

[58] Field of Search ..... 62/3

[56] References Cited

U.S. PATENT DOCUMENTS

| | | | |
|---|---|---|---|
| 2,886,618 | 5/1959 | Goldsmid | 62/3 X |
| 3,085,405 | 4/1963 | Frantti | 62/3 |
| 3,194,024 | 7/1965 | Bassett, Jr. | 62/3 |
| 3,552,133 | 1/1971 | Lukomsky | 62/3 |
| 3,858,106 | 12/1974 | Launius | 62/3 X |
| 3,986,337 | 10/1976 | Richard | 62/3 |
| 4,007,600 | 2/1977 | Simms | 62/3 |

*Primary Examiner*—Lloyd L. King

*Attorney, Agent, or Firm*—Frank D. Gilliam

[57] ABSTRACT

An improved air dryer having a heat exchanger through which ambient air passes between an input and an exit. The air passing through the heat exchanger for drying is normally chilled by the cold side of a thermoelectric module attached thereto. The normally opposite hot side of the thermoelectric module is attached to a heat sink which includes a fan which pulls ambient air through the heat sink for dissipating the heat from the thermoelectric module. The air passing through the heat exchanger is cooled by the thermoelectric module to a temperature below its dew point, causing the moisture in the air to be deposited on the chilled air passage walls of the heat exchanger, where it is frozen. When the air passageway of the heat exchanger becomes substantially closed by the ice formation on the walls thereof, the current to the thermoelectric module is reversed, whereby the normally cold side becomes the hot side and vice versa and, simultaneously, the air exiting is directed from an exit path to an alternate exit path. The heated ice, the ice formed on the passageway of the heat exchanger, thaws and is removed through the alternate exit path. The cooling and heating is then alternately repeated during the operation of the dryer. A timer is used to control the alternate reversing.

7 Claims, 2 Drawing Figures

AIR DRYER

BACKGROUND OF THE INVENTION

This invention relates to the production of dry air from ambient air and, more particularly, is directed to producing dry air by means of a thermoelectric module which lowers the temperature of the air to be dried below its dew point and collects the accumulated moisture by freezing.

A thermoelectric dehumidifier is taught by U.S. Pat. No. 3,050,948 wherein a plurality of thermoelectric elements are alternately arranged to form a set of hot junctions and cold junctions. A fan pulls air first over the cold junctions and then over the hot junctions before being discharged.

Other thermoelectric module cooling and heating systems are taught by U.S. Pat. Nos. 3,255,593 and 3,327,485.

SUMMARY OF THE INVENTION

The invention is directed to dehumidifying air by means of a thermoelectric module in accordance with the Peltier effect. Ambient air containing moisture is forced through a heat exchanger attached to one surface of a thermoelectric module which initially is supplied a direct current at a polarity that causes the heat exchanger side of the thermoelectric module to operate at a reduced temperature. The opposite side of the thermoelectric module is connected to a heat sink for dissipating the heat generated by the normally hot side of the thermoelectric module. The heat sink includes fins or blades and a plenum chamber through which ambient air is forced by a fan to enhance the cooling of the hot side of the thermoelectric module. The heat exahanger has a finite length passage between the air input and the air exit. The passage is formed by a plurality of cooling fins alternately attached to opposing walls in an adjacent nesting relationship. The space between these fins is in the range of 0.030 to 0.070 inches, thus providing a wide, flat path for the air flow. The ambient air is caused to flow across these cold fins, which reduces the air temperature below its dew point, causing the moisture to collect and freeze on the fins, thus drying the air exiting the heat exchanger. Depending on the moisture content of the entering air, after several hours of operation, the space between the fins becomes filled with ice. When this occurs, the current to the thermoelectric module is reversed and the exiting air from the heat exchanger is diverted from a first normal path to a second exhaust path. The former cold side of the thermoelectric module now becomes the hot side and causes the ice formed in the heat exchanger passageway to melt and be forced from the heat exchanger along the second path, where it is exhausted from the system. When the ice is removed from the heat exchanger, the current to the thermoelectric module is then returned to its prior polarity state, again with the normally cold side adjacent the heat exchanger, and the air flow from the heat exchanger is again directed along its first exit path.

An object of this invention is to produce dry air by an improved thermoelectric dehumidifier having improved performance characteristics.

Another object of this invention is to produce dry air by the use of a thermoelectric module wherein the current to the module is periodically reversed.

Another object of this invention is to produce dry air by lowering the air temperature below the dew point and freezing the accumulated moisture.

Stil another object of this invention is to produce dry air by the use of a thermoelectric module by passing the air adjacent the cold surface of the module where the air is reduced in temperature below its dew point and the moisture formed thereby is frozen, periodically stopping the flow of air, reversing the current to the module, causing the accumulated ice or frost to melt and discharging the melt from the system and the resuming the dehumidifying process.

Further objects and advantages of the present invention will become apparent from the following description and the features of novelty which characterize the invention will be set out with particularity in the claims annexed to and forming a part of this specification.

DETAILED DESCRIPTION OF THE PREFERRED EMBODIMENT

Figure 1:
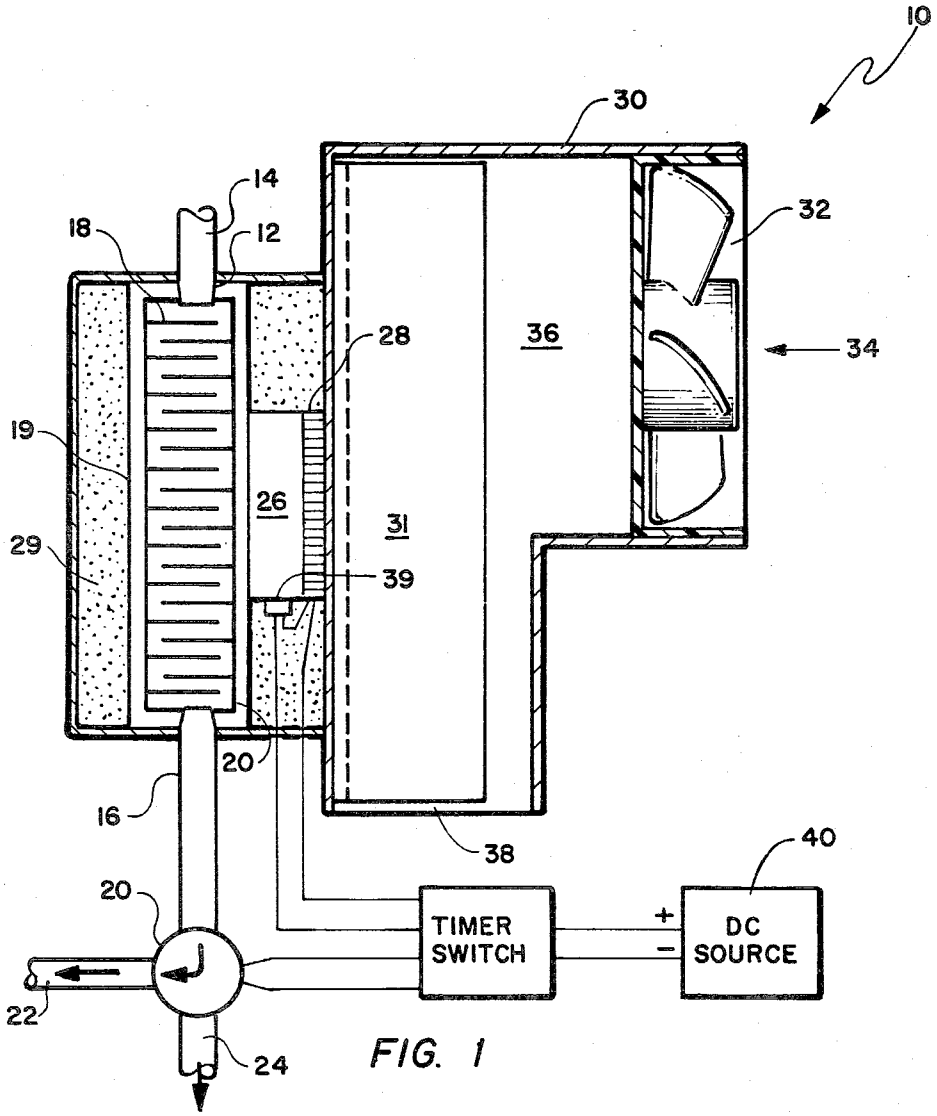
FIG. 1 is a schematic or diagramatic representation of a thermoelectric dehumidifier embodying the principles of the invention.

Referring now to FIG. 1, the air dehumidifier 10 includes a heat exchanger 12. The heat exchanger is a sealed unit having an inlet 14 through which the air to be dried enters the heat exchanger and an outlet 16 from which the dried air leaves the heat exchanger. Normally, the air entering the inlet will be under a greater pressure than the air leaving the outlet, thus causing air to flow from the inlet through the heat exchanger and out the outlet. The air passage through the heat exchanger is wide and very flat or narrow. This path is formed by attaching a plurality of plates or fins 18 on opposing walls 19,20 of the heat exchanger. The plates or fins are alternately attached to the walls in an adjacent nested manner as shown. The space between the adjacent plates or fins 18 ranges from 0.030 to 0.070 inches. Around 0.030 inches is ideal. The heat exchanger 12 may be formed by connecting together, by welding or like means, a pair of conventional finned heat sinks positioned with opposing nested fins and an inlet and outlet opening.

The outlet opening 16 is attached to an electric solenoid valve 20 which is capable of switching the air exiting the heat exchanger to a selected one of two separate paths 22,24. Path 22 is considered the path for the dry air produced by the device and the path 24 is the path for unusable air to exit the system.

Connected to surface 20 of the heat exchanger is a platform 26 constructed of a good heat transfer medium such as copper, aluminum or the like. The platform 26 acts as a spacer between the heat exchanger and the normally hot side of the module for insulation. Substantially, the entire platform surface adjacent wall 20 must have contact to insure good heat transfer. The opposite surface of the platform 26 is attached to one surface of a thermoelectric module 28. Insulation material 29 such as expanded foam or the like is positioned in the free space between the heat exchanger and the heat sink to provide additional insulation therebetween.

Figure 2:
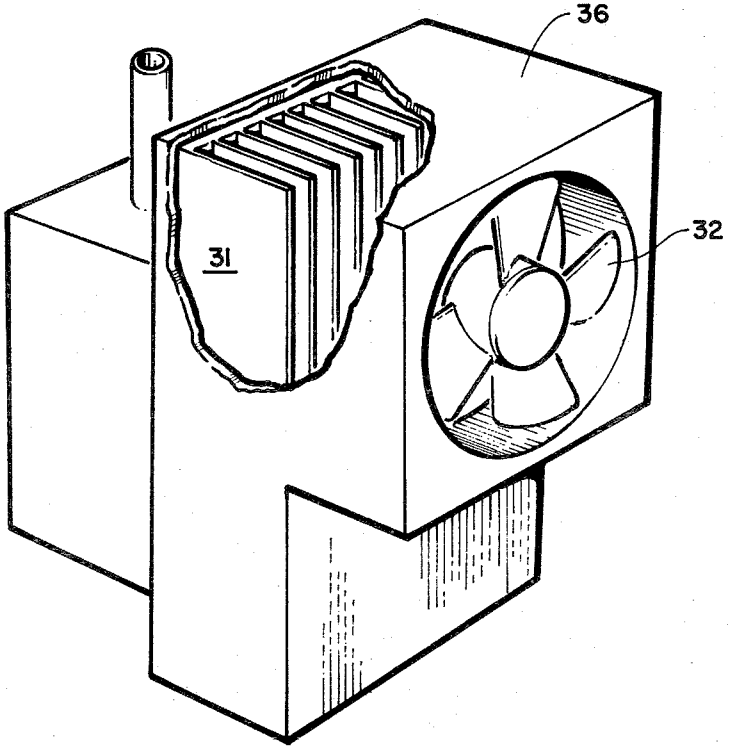
FIG. 2 is a perspective showing of FIG. 1 partially cut away to expose the fins or blades of the heat sink.

The opposite side of the module 28 is connected to a heat sink 30. The heat sink 30 includes internal blades or fins 31 (See FIG. 2) and a fan 32 of the muffen type or equivalent, which draws air through opening 34 into chamber 36, across fins 31 and out the exit 38. This air circulation aids the heat sink 30 in dissipating the heat produced by the adjacent side of the thermoelectric module 28 when in its normal hot operating mode. A thermo-cutoff switch is attached to the hot side of the module and wired in series with one of the D.C. voltage supply leads for disrupting power to the module if the module surface temperature reaches a predetermined level. When the temperature is reduced to shutoff of power, the switch closes and again completes the circuit to the module. The switch may cycle a number of times during any time period.

A source 40 of direct current voltage (D.C.), supplied from any convenient means, such as, for example, a battery, alternating current rectification, etc., supplies current to a timer/switch combination 42. The timer/-switch combination provide a continuous current to the thermoelectric module 28 at a preselected polarity and at least a momentary current to the electric valve 20 each time the polarity of the current supplied to the module is reversed. The polarity of the current supplied to the electric valve 20 will generally be the same as that supplied to the module 28.

The module 28, the electric valve 20, and the timer/-switch combination are all conventional and well known in the art.

OPERATION OF THE DEHUMIDIFIER

From an ambient temperature startup, the module is energized from the D.C. source through the timer/-switch combination at a polarity that causes the heat exchanger side of the module 26 to become cold and the heat sink side to become hot. After the plates or fins 18 of the heat exchanger reach a temperature below the dew point of the air to be drawn through the exchanger, the air to be dried is then supplied under pressure to the exchanger. The air flowing across the surface of the plates or fins 18 is reduced in temperature below its dew point, and moisture is formed along the plate or fin surfaces. The surface of the plates, now reduced below the freezing temperature of the collected moisture, causes the moisture to frost or freeze to the plates. The air flow through the heat exchanger is continued for a selected period of time and during this time dry air is passed through valve 20, out the outlet path 22 for its intended use. The period of time selected is the length of time that is required for the ice or frost accumulation to begin to seriously obstruct the air flow through the passage of the heat exchanger. This time period is generally two to two and one half hours, but may be more or less, depending on the speed of the air flow, space between the plates or fins, temperature of the plates or fins and moisture content of the incoming air. The timer in the timer/switch combination is pre-set for the desired time period. It should be understood that air flow indicators, pressure indicators or the like may be used to override the timer or may be used in place of the timer.

When the selected period of time occurs, the timer activates a pair of switches (not shown) therein which reverses the polarity of the voltage supplied the module, thus reversing the current and momentarily supplying voltage to the valve 20 at the new polarity, which switches the valve outlet from path 22 to path 24. The timer is pre-set for a selected time period before again activating the switch so as to return the voltage to its prior polarity. The reversing of the polarity causes the normally cold side of the module 28 to become the hot side and vice versa. The heating of the plates or fins 18 causes the ice or frost buildup on the plates or fins to melt and be removed from the heat exchanger through exhaust path 24 by the normal air flow therethrough.

The time period for the module to be at the new polarity (the heating cycle) ranges from three to five minutes or more. The exact time is determined from the variables above discussed directed to the first polarity cycle. When the second cycle is completed, the timer again switches the polarity of the continuous direct current to the module and the momentary current to the electric valve 20. The dehumidifier cycle is then repeated and so on.

While this invention has been described in connection with certain specific embodiments thereof, it is to be understood that this is by way of illustration and not by way of limitation; and the scope of this invention is defined solely by the appended claims which should be construed as broadly as the prior art will permit.

What is claimed is:

1. An improved air dryer comprising:

a heat exchanger having an air inlet and outlet with an air passage therebetween, said air passage is of finite length and has one dimension in the range of 0.020 to 0.070 inches;

a heat sink having an ambient air entrance and exit with communications therebetween;

a fan means associated with said heat sink for pulling air into said entrance, forcing air through said entrance and out said exit;

a thermoelectric module means attached to and sandwiched between said heat exchanger and heat sink for thermocommunication therewith;

a direct current voltage supply means; and switching means for periodically and simultaneously reversing the current to said thermoelectric module and directing the air from said outlet between a first and second exit path.

2. The invention as defined in claim 1 wherein said heat exchanger includes internal fins alternately connected to opposing surfaces therein in a perpendicular relationship forming said air path therebetween.

3. The invention as defined in claims 1 or 2 wherein said one dimension of said passage is in the range of 0.030 to 0.050 inches.

4. The invention as defined in claims 1 or 2 wherein said one dimension is approximately 0.030 inches.

5. The invention as defined in claim 1 wherein said switching means comprises a current-reversing switch which reverses said current between a first direction to a second direction and actuates a valve means which switches said air from said outlet between a first exit path and a second exit path.

6. The invention as defined in claim 1 wherein a platform means is interposed between said heat exchanger and said thermoelectric module.

7. A method of dehumidifying air, comprising the steps of:

(a) flowing air through a heat exchanger having a passage defined by a plurality of adjacent flat plate surfaces;

(b) directing the air from said heat exchanger to a first flow path for use;

(c) cooling the surface temperature of said plates to a temperature below the freezing temperature of moisture carried by said air whereby the moisture from the air condenses and freezes on the surface of said plates;

(d) elevating the surface temperature of said plates and directing the air from the first flow path to a second flow path simultaneously, whereby the ice collected on said plates melts and exits said second flow path; and (e) repeating steps b–d above periodically.

* * * * *